United States Patent [19]

Elliott

[11] 4,095,229

[45] June 13, 1978

[54] TRIBAND VEHICLE ANTENNA

[75] Inventor: James O. Elliott, Xenia, Ohio

[73] Assignee: General Motors Corporation, Detroit, Mich.

[21] Appl. No.: 770,814

[22] Filed: Feb. 22, 1977

[51] Int. Cl.[2] ..... H01Q 1/32; H01Q 5/00

[52] U.S. Cl. ..... 343/715; 343/749; 343/852; 343/858; 343/889

[58] Field of Search ..... 343/713, 715, 749, 852, 343/858, 889, 903

[56] References Cited

U.S. PATENT DOCUMENTS 4,037,177 7/1977 Tyrey ..... 343/858

*Primary Examiner*—Eli Lieberman

*Attorney, Agent, or Firm*—C. R. Meland

[57] ABSTRACT

An antenna for simultaneous connection to a citizen's band transceiver, an AM receiver and a FM receiver, particularly suitable for use on a vehicle such as an automobile. The antenna proper is a center-loaded upstanding rod which, in the preferred form, telescopes downwardly to a retracted position where it does not protrude above the ground plane. The antenna proper is connected to a T-connected open stub transmission line and to a FM resonant relatively high impedance signal-carrying transmission line. The former has inductive reactance in the FM band which offsets the capacitive reactance of the relatively short effective length of the antenna proper in the FM frequencies. The signal-carrying transmission line is substantially half wave in length in the FM band so as to reflect impedance at its far end substantially equal to the impedance present at the T-connection. The signal-carrying transmission line is also of length that provides resonant action transforming the relatively low impedance at the T-connection or base of the antenna in the CB band to a higher impedance, such as 50 ohms, at the end of that transmission line. Finally, the signal-carrying transmission line, because of its relatively high characteristic impedance, has very low capacitance and therefore does not tend to load the AM radio. The end of the signal-carrying transmission line is connected to the input terminal of splitter containing resonant circuits which are in turn connected to two transmission lines, one leading to the CB transceiver and the other leading to the AM/FM radio.

3 Claims, 3 Drawing Figures

TRIBAND VEHICLE ANTENNA

DESCRIPTION

The present invention relates to multiband antennas and, particularly, to an antenna especially suitable for use on vehicles and effective to receive and transmit CB signals from a CB transceiver and to receive AM and FM radio signals.

Antennas used in vehicles, such as automobiles, need to be short in length and at the same time need to provide effective impedance match to the radio units to which they are connected. When an AM/FM radio, or the equivalent, is to operate from the same antenna as a CB transceiver, this requirement is especially difficult to meet since the requisite impedance match must be achieved as to each operating frequency without affecting the others. In accordance with the present invention, this is achieved through the combined use of a resonant open ended transmission line and a resonant signal-carrying transmission line connected in T fashion to the transmission line connector at the antenna proper. The signal-carrying transmission line is cut to a length that provides resonant transmission line transformer action that steps up the relatively low impedance to CB frequencies at the T-connection to about 50 ohms as required for connection to the CB transceiver. This same transmission line is of length approximating one-half wavelength in the FM band, so that while it is operating in resonant fashion it nevertheless has essentially the same impedance at each end with respect to FM frequencies. The open stub transmission line attached to the T offsets the reactive impedance component of the relatively short antenna effective at FM frequencies so as to provide approximately 50 ohms, for example, at the T-connection (which is also about 50 ohms, for example, at the end of the signal-carrying transmission line). The signal-carrying transmission line is connected to a coupler containing suitable filters and has output terminals for the transmission lines extending to the separate ratio units.

It is a general object of the present invention to provide an improved multiband antenna effective in the CB, FM, and AM radio bands, to wit, 26.95 to 27.405 MHZ. 88 to 108 MHZ. and 550 to 1,600 KHZ. respectively.

A more specific object of the present invention is to provide an improved multiband of the above type that is particularly suitable for use in vehicle installations.

Still another object of the present invention is to provide an improved multiband antenna of the above type that uses a single signal-carrying transmission line having relative high impedance, as a resonant line in the CB and FM bands providing a relatively low impedance match at its end and at the same time minimizes capacitance loading in the AM band.

Yet another object of the present invention is to provide an improved multiband antenna having a signal-carrying line that advantageously uses the impedance preserving property of a half wave line, operating in the FM band, and the impedance transforming property of the same length line, when operating in the CB frequencies, all in conjunction with an open stub transmission line at the antenna end of such line so as to provide proper impedance match at the end of the signal-carrying line.

Still further it is an object of the present invention to provide an improved multiband antenna suitable for vehicle use to operate both a CB transceiver and AM/FM radio receiver in which trimming to accommodate varying installation conditions and vehicle configurations can be done separately as to the FM band and as to the CB band by cutting separately an open stub transmission line length and the signal-carrying transmission line length, each trimming being substantially independent of the other so that separate adjustments can be individually made and optimum trimming attained.

Further and additionally, an object of the present invention is to achieve the foregoing objects in a new and improved antenna characterized by the absence of switches, low cost, good durability, adaptability for varying installations and other characteristics making it especially suitable for practical usage, including OEM use as a common system in a variety of automobile sizes and models.

The novel features which I believe to characterize my invention are set forth with particularity in the appended claims. My invention itself, however, both as to its organization and method of operation, together with further objects and advantages thereof, will be best understood by reference to the following description taken in conjunction with the accompanying drawings in which:

Figure 1:
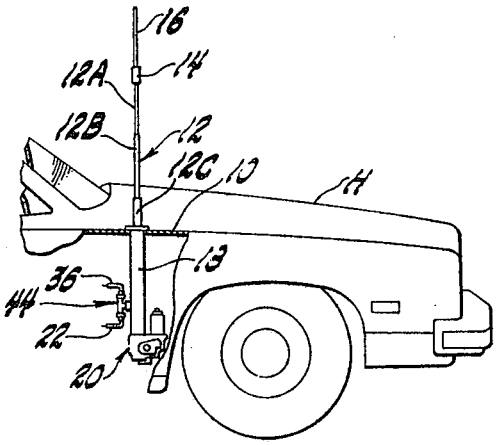
FIG. 1 is a view, partially broken away, of the front portion of an automobile having an antenna constructed in accordance with the present invention.
Figure 2:
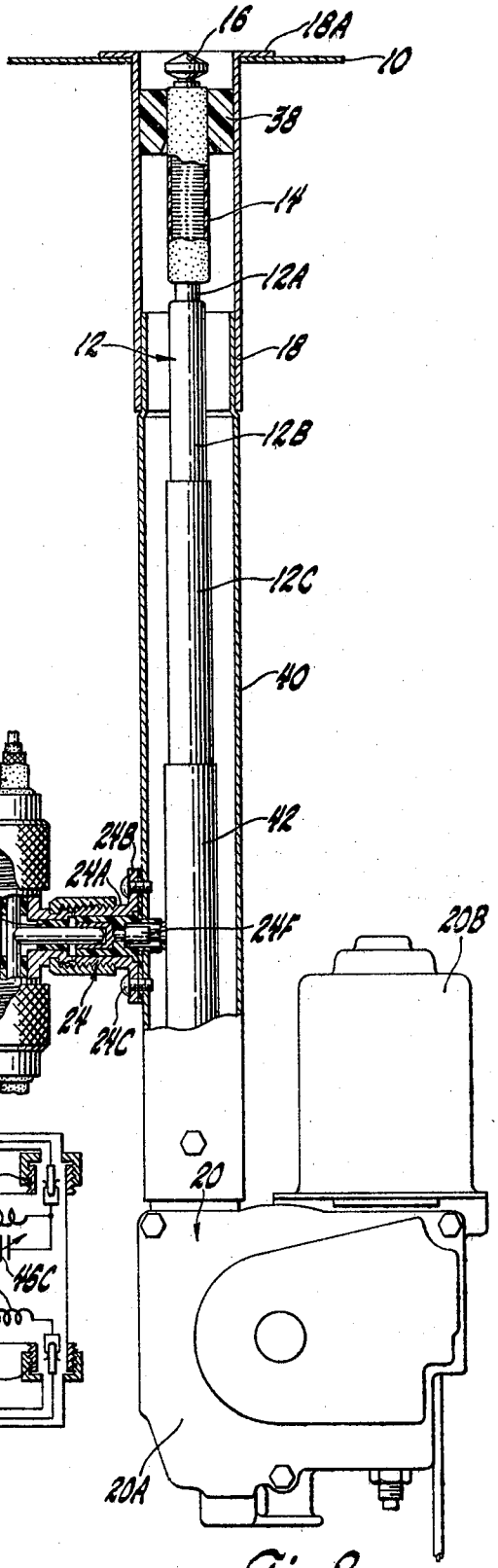
FIG. 2 is an enlarged view showing the retractor mechanism of the most preferred form of the invention with the parts partially broken away and with the antenna in retracted position.
Figure 3:
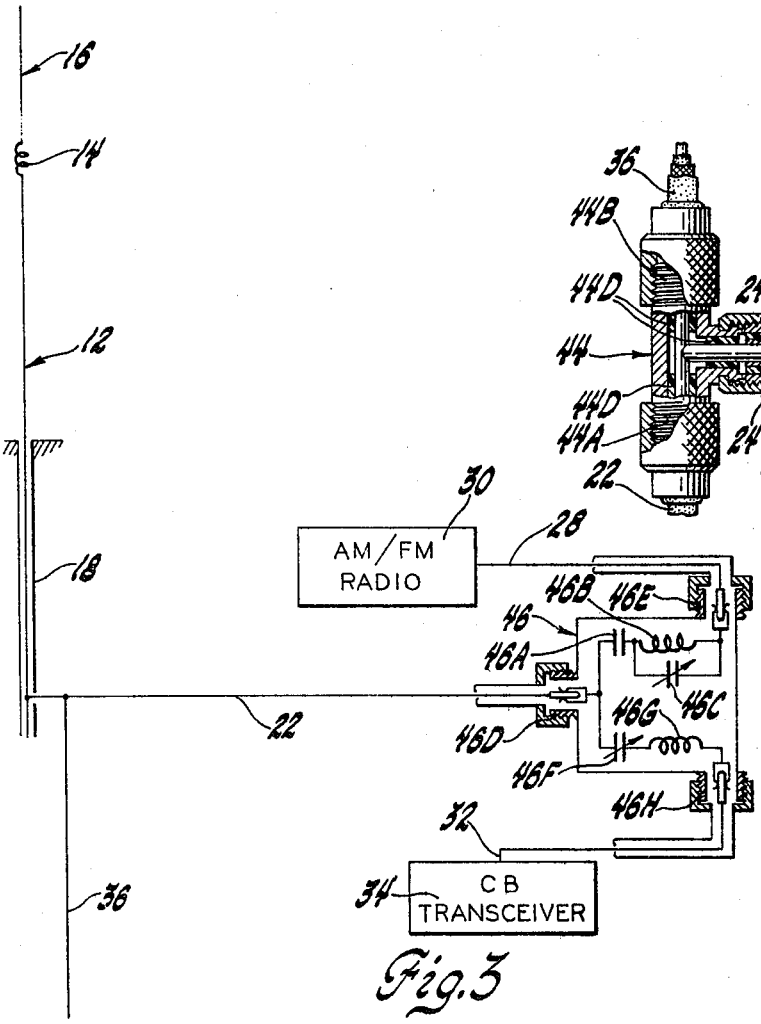
FIG. 3 is an enlarged but somewhat diagrammatic view of the complete antenna system.

As shown in FIG. 1, the unit of the present invention may be mounted on a flat horizontal surface such as the fender covering portion 10 of the hood H of an automobile shown in partial view, forming the "ground plane". In the elevated position shown, the antenna consists of a lower radiating section 12, a loading coil 14, and an upper radiating section 16. These portions of the antenna are supported by the antenna support tube 18 which is preferably mounted upon the substantially flat horizontal support, such as fender cover 10. This may, for example, consist of an outwardly extending annular flange 18A, FIG. 2, seating on the horizontal flat member 10 and attached thereto by welding or other suitable attaching arrangements (not shown). Of course, if desired, other support arrangements may be provided, so long as the depending tube 18 is securely and rigidly supported in vertical position in relation to the support 10; as shown in FIGS. 1 and 2, there is also provided an antenna elevating and retracting unit 20. Signal-carrying coaxial cable 22, FIG. 3, extends from a suitable antenna connector 24 and T-connector 44, FIG. 2, to an in-line splitter 46 as is further described hereafter with reference to FIG. 3. Splitter 46, in turn, receives coax cable 28 which extends to the AM/FM radio receiver 30. Splitter 46 has an additional output terminal which receives the coax cable 32 which in turn extends to the citizens band or CB radio transceiver 34. An open stub section of coax cable 36, FIG. 3, is connected to the T-connector 44 as hereinafter described.

In use, the antenna elements 12, 14 and 16 are in the elevated positions shown in FIG. 1. The AM/FM radio 30, FIG. 1, is preferably located in the vehicle passenger compartment, normally on the dashboard for easy access by the driver. It can be turned off and on and tuned in normal fashion and without regard to the operation of the CB radio system. CB radio transceiver 34 is normally located in the driver's compartment where it can be turned off and on and adjusted as the driver or front seat passenger elects. No antenna adjustments are required for use or nonuse of either of the radio units 30 or 34 except elevation of the antenna to the elevated position shown in FIG. 1.

FIG. 2 shows an enlarged view of the antenna unit in the retracted position. In this position, the top antenna element 16, FIGS. 1 and 2, is telescoped downwardly within the loading coil 14. The latter is received within the insulating support collar 38, as shown in FIG. 2. The coil 14 is in turn supported by the upper portion 12A of the lower antenna portion 12, FIG. 2, which in turn is telescoped within the next lower section 12B which in turn is telescoped within section 12C. The latter is telescopically received by the conducting sleeve 42. A flexible insulating control cable (not shown) is affixed to the portion 16 of the antenna and extends telescopically within the support 42 downwardly into the housing 20A of the erecting portion 20. This housing includes a reel (not shown) onto which this flexible erecting cable is wound in the retracted position of FIG. 2. A motor 20B is connected to the reel by suitable gearing (not shown).

In the retracted position of the antenna, shown in FIG. 2, the motor 20B has been energized in the cable wind-up position so as to pull the antenna element 16 down to the retracted position shown in FIG. 2. This action serves to bring each of the elements 14, 12A, 12B, and 12C to the retracted position as it is engaged successively by the next adjacent element. A limit switch or other suitable arragement (not shown) deenergizes the motor 12B when the antenna is completely retracted. To erect the antenna, the motor 20B is energized in the opposite direction and extends the flexible reel previously wound on the reel. This elevates antenna element 16 and it in turn lifts each of the elements 14, 12A, 12B, and 12C in succession as these elements engage. The energizing circuit to the motor 20B is provided with a suitable limit switch or other arrangement (not shown) to deenergize it when the antenna is thusly erected.

The antenna cable connector 24 is composed of an outer housing tube 24A having flanges 24B which are secured by screws or other attaching devices 24C to the side of the lower housing tube 40 of the unit. The housing sleeve 24A has an outer threaded circular or cylindrical portion and a cylindrical bore in this portion which receives the insulating support which, in turn, supports the pin 24F. Pin 24F defines the inner coax conductor. Pin 24F extends into the tube 40 and at its end has a wiper in electrical contact with the lowermost antenna sleeve 42, as shown. The pin 24F is thus in electrical contact with the antenna. As shown in the cut away portion of FIG. 2, the coax coupler 24 threadedly receives the coax T-connector 44. This is of conventional construction with one end threaded to be received over the threads of connector 24 and defining two ends 44A and 44B, respectively, adapted to receive couplers to each of two coaxial lines, 36 and 22, respectively. The coax transmission lines 36 and 22 are thusly connected to the antenna conductors 42, 12, 14, and 16 via the coax connector 24 and the three-way coax connector 44, providing an effective connection of each of cables 22 and 36 to each other and to the antenna at substantially the same point. Variants may be made in the construction as specifically shown in FIGS. 1 and 2 so long as an effective three-way connection is formed for the antenna and transmission lines 22 and 36.

FIG. 3 shows a more detailed, but somewhat diagrammatic, form of the overall arrangement. The transmission line 36 is an open resonant section which serves to provide antenna impedance match in the FM frequency band, and some broadbanding effects in the citizens band frequency. The coax cable 22 extends to the input terminals of the in-line splitter 46. This in-line splitter has circuit elements as shown diagrammatically in FIG. 3. These include a capacitor 46A, inductor 46B and variable capacitor 46C defining a circuit from the input connector to the output connector 46E which receives in turn the coax line 28 extending to the AM/FM radio 30. As shown, this connection defines a parallel inductor-capacitor combination 46B and 46C in series with the capacitor 46A. This unit is tuned to form a high impedance to citizens band frequencies (approximately 27 megahertz) so that the AM/FM radio is electrically isolated as to these frequencies from signal-carrying transmission line 22. The in-line splitter further defines a circuit through variable capacitor 46F and inductor 46G between the input terminal at 46D and the output terminal 46H. The latter receives coax line 32 which extends to the CB transceiver. Variable capacitor 46F and inductance 46G serve to isolate the CB transceiver from the remainder of the system at FM frequencies, that is around 100 megacycles.

In one practical construction of the antenna system of the present invention, the following dimensions and elements were used:

1. Upper radiating section 16—11¼ inches long.
2. Loading coil 14—2¼ inches long, 56 turns of 28 gage wire on a 7.6 mm diameter form.
3. Lower radiating sections 12A, 12B, and 12C together—22.5 inch extension above the plane of panel 10, FIG. 1.
4. Open stub transmission line 36, 53 ohm cable (such as RG 58)—29 inches long.
5. Coax cable 22—125 ohm cable, 47 inches long, capacity approximately 9 picofarads per foot.
6. Inductances 46B and 46G in in-line splitter 46—0.88 microhenries each.
7. Transmission line 28, RG 58 coax cable of appropriate length such as 30 inches.
8. Coax line 32, RG 58 cable of appropriate length such as 30 inches.

The antenna of the present invention is characterized by effective operation despite the fact that the radiating elements are electrically short at each of the wavelengths where operation occurs. In the CB frequency bands (from about 26.95 to 27.405 megahertz) the unit composed of upper sections 16, loading coil 14, and lower sections 12A, 12B and 12C operate as a loaded antenna, with its resonant frequency substantially within this range. The open stub transmission line 36 somewhat broadens the frequency range over which the antenna is effective. It is believed that this action results from the capacitance of this open stub cable, which acts in the resonant system to provide a broadbanding effect. The signal-carrying transmission line 22 in the citizens band antenna range is about 0.15 wavelengths long, electrically. It acts as a resonant transmission line substantially matching the 53 ohm impedance at the input terminal 46D of the in-line splitter 46 to the approximately 20 ohms impedance at the coupler 24 in the CB frequencies. The in-line splitter through the elements 46F and 46G provides a substantially 53 ohm output connection 46H to which 53 ohm transmission line 32 is attached and extends to the CB transceiver. Transmission line 32 acts in a nonresonant mode and may be whatever length is convenient.

In the FM bands, from about 87 to 108 megacycles, loading coil 14 serves as an isolating element so that the effective radiating length of the antenna is largely defined by lower section 12, FIG. 1. This length is electrically short, forming a capacitive reactance as seen at connector 24. The impedance of the antenna unit without line 36 under this condition is around 20 ohms real impedance and substantially capacitive. The open stub on line 36 is about ¼ wavelength physically and ⅜ wavelengths electrically at the FM frequencies. It resonates to form an inductance which resonates with the capacitance of the antenna in the FM receiver frequencies providing approximately a 53 ohm impedance as seen at the connector 46. The coax line 22 is approximately ½ wavelength electrically at the FM frequencies. Signal-carrying cable 22 thus acts as a resonant transmission line which reflects at the input terminal 46D of the in-line splitter 46 substantially the same impedance as it "sees" at its opposite end at connector 44. While the 125 ohm cable constituting signal-carrying transmission line 22 does not match the input and output impedances of this cable, this is unimportant since this cable is acting in resonant fashion at the FM frequencies and because of the resonant action reflects essentially the same impedance at each end. The in-line splitter 46 provides a 53 ohm output, approximately, at the connector 46E through the capacitor 46A and the parallel inductance 46B and trimmer capacitor 46C at FM frequencies. The coax cable 28 extending to the AM/FM radio 30 substantially matches this impedance and the approximate 50 ohm input impedance to the FM radio and acts in a nonresonant fashion to provide appropriate and effective coupling to the AM/FM radio 30.

The antenna arrangement of the present invention provides a number of advantages, resulting from the coaction of the separate portions. First, in the AM broadcast band, from 550 to 1,600 kilohertz, the upstanding antenna elements 16, 14 and 12 act as a nonresonant antenna which, although short, provides effective signal pickup comparable to that of a straight antenna of like length. The signal-carrying transmission line 22 in AM operation also acts in nonresonant fashion. However, this transmission line is composed of a coaxial cable having a characteristic impedance of approximately 125 ohms. This characteristic impedance is the result of the designed low capacitance per foot of length. The capacitance of this cable may be only about 9 picofarads per foot of length. This is desirable in the actual use of the antenna system because AM/FM radios are designed for usage with a predetermined and limited length of coaxial cable feed, such as 50 inches. If the capacitance across the input terminals to the radio is much in excess of that associated with about 50 inches of cable plus the antenna capacitance, it becomes difficult, and may be impossible, to tune the AM radio circuits when the set is installed. A feature of the present invention in its preferred form is that the cable 22 is greater than the impedance of the other cables and the input impedance of the splitter 46 and yet is more effective in this aspect than if a match were obtained.

With respect to citizens band operation, in the relatively narrow frequency band of 26.95 to 27.405 megahertz, the antenna of the present invention is also effective. Indeed, it is substantially as effective as an antenna designed for the sole purpose of CB operation and having a like length. The loading coil 14 is designed with the proper inductance and distributed capacitance to provide most effective operation in the CB frequency band. While this gives an impedance of about 20 ohms as measured at 27 megahertz and at the connectors 24 and 44, signal-carrying transmission line 22 is of length to serve as an impedance transformer so that the impedance as seen by the input terminal 46D of in-line splitter 46 is approximately 50 ohms of real impedance plus an inductive reactance. Between the output terminal 46H of the splitter and the CB transceiver 34, the entire system is a matched system at every point having, for example, a 50 ohm impedance. With respect to CB operation, the system can be trimmed for most effective operation to accommodate the variations from one car to another, by varying the length of the signal-carrying transmission line 22. This varies the impedance transformer affect of this line and thereby provides a match. Within reasonable limits, this does not degrade the half wave operation of the signal-carrying line 22 in the FM band.

The antenna of the present invention, in addition to providing impedance transformer action at the transmission line 22, also provides by this transmission line an approximate ½ wavelength coupling at the FM frequencies of 88 to 108 megahertz. This is resonant action which does not particularly depend on the impedance of the cable 22 as long as it is electrically ½ wavelength. Thus, the characteristic impedance of cable 22 can be mismatched in relation to the input impedance of the in-line splitter 46 at one end and in relation to the impedance at the connector 44, at the other end. The antenna length amounts to only about 22 inches length in the FM frequencies, and this gives the FM impedance of the antenna at coupler 24 a value of about 20 ohms real plus a capacitive component. However, the open stub of transmission line 36 offsets the capacitive component of this impedance and brings the effective impedance up to a real value of about 50 ohms, for example. The length of the stub 36 can be trimmed for the best FM reception in each installation. This trimming does not significantly affect the operation in the CB frequencies, nor does it significantly affect operation in the AM frequencies.

Thus, the antenna system can be trimmed to provide best operation in each of the FM and CB frequency bands and it does not significantly load the radio input in the AM band, and is suitable for practical usage in automobile radio installations.

What I claim is new and desired to secure by letters patent of the United States is:

1. A system suitable for CB transceiver operation and AM/FM radio receiver operation in a vehicle having a substantially horizontal conducting panel defining a ground plane, including: means defining a substantially vertical well extending downwardly below the panel; an antenna element coaxial with said well and movable between a retracted position telescoped into the well and in operating position extending upwardly from the well, the antenna element in operating position having a lower conductor length above the panel, a loading coil extending above the first conductor length, and an upper conductor length extending above the loading coil, the whole having a length of the order of 3 feet; a splitter unit adapted to receive input connection from a transmission line and defining output connections adapted to be connected to the radio frequency input of an AM/FM radio or the like and the radio frequency input/output terminals of a CB transceiver unit, respectively; means defining a signal-carrying transmission line of substantially half wave electrical length in the FM band and connected from the input connections of the splitter unit and the antenna element, said transmission line having a relatively large characteristic impedance in relation to the attached input impedance of the splitter and therefore low capacity per unit length; means defining an open stub transmission line attached to said last transmission line adjacent the connection of the antenna element, said open stub transmission line exhibiting an inductive reactance in the FM frequency band offsetting the capacitive reactance of the antenna element so providing impedance in the FM band at the junction of the first transmission line and the antenna element substantially equal to the impedance of the input terminals of the radio receiver at FM frequencies, whereby the length of the open stub may be adjusted to provide impedance match in the FM frequencies without substantially affecting operation in the AM band or the CB band, and the length of the signal-carrying transmission line may be adjusted to provide proper impedance match for the CB frequency range.

2. A system suitable for CB transceiver operation and AM/FM radio receiver operation in a vehicle, having a substantially horizontal conducting panel defining a ground plane including:

means defining a substantially vertical well extending downwardly below the panel;

an antenna element coaxial with said well and movable between a retracted position telescoped into the well and an operating position extending upwardly from the well, the antenna element in operating position having a lower conductor length above the panel of approximately 22 inches length, a loading coil extending above said first conductor length having inductance of a value forming substantial and isolating impedance in the FM band, and an upper conductor length extending above the loading coil and having a length of approximately 11 inches;

a splitter unit adapted to receive input connections from a transmission line and defining output connections adapted to be connected to the radio frequency input of an AM/FM radio and the radio frequency input/output terminals of a CB radio unit, respectively;

means defining a signal-carrying transmission line of approximately 47 inches length connected between the input connections of the splitter unit and a point on the antenna element adjacent the conducting panel; and means defining an open stub transmission line of such length and construction as to offset the capacitive reactance of said antenna element in the FM band compatible with and attached to the junction of said signal-carrying transmission line and the connection to the antenna element;

whereby the length of the open stub may be adjusted to provide impedance match in the FM frequencies without substantially affecting operation in the CB band, the length of the signal-carrying transmission line may be adjusted to provide proper CB impedance match without substantially affecting other operation, and the reactive components of said splitter unit may be adjusted to provide isolation of the AM/FM radio input terminals from the CB unit.

3. An antenna system for CB transceiver operation and AM/FM radio receiver operation in conjunction with a substantially horizontal conducting panel defining a ground plane, including:

an antenna upstanding from the panel having a lower conductor length, a loading coil located above said lower conductor length, and an upper conductor length above said loading coil, said loading coil having substantial and isolating impedance in the FM band, the lower conductor length forming a non-resonant vertical antenna in the FM band, and the antenna element as a whole forming a resonant vertical antenna in the CB band;

a splitter having a pair of input terminals and pairs of output terminals for the CB transceiver and the AM/FM radio receiver, respectively;

and a pair of resonant transmission lines connected to the end of the antenna element adjacent the panel, one of said transmission lines being open-ended and the other of said transmission lines being signal-carrying and connected to the input terminals of the splitter;

the length of the open-ended transmission line being such as to provide impedance match of the antenna for FM reception to the input terminal of the splitter, and the length of the signal-carrying transmission line being approximately a half wave in the FM band and transformer action and said splitter matching the antenna to the input terminals of the CB transceiver, whereby the antenna operates efficiently in the AM, FM, and CB bands and may be trimmed substantially independently as to the FM and CB bands.

* * * * *